US006293192B1

(12) United States Patent
Bartlett

(10) Patent No.: US 6,293,192 B1
(45) Date of Patent: Sep. 25, 2001

(54) NEWSPRINT CORE BRAKE SYSTEM FOR NEWSPAPER PRESSES

(76) Inventor: Norman C. Bartlett, 1024 Golden West Ave., Apt 2, Arcadia, CA (US) 91007-7148

( * ) Notice: Subject to any disclaimer, the term of this patent is extended or adjusted under 35 U.S.C. 154(b) by 0 days.

(21) Appl. No.: 09/541,662

(22) Filed: Apr. 3, 2000

(51) Int. Cl.[7] ..... B41F 13/00

(52) U.S. Cl. ..... 101/212; 101/228; 242/421.6; 156/504; 226/30

(58) Field of Search ..... 101/181, 212, 101/219, 220, 226, 228–248, 484, 485, 490; 226/28, 30, 33, 38, 43, 44, 45; 242/417.2, 421.1, 421.6; 156/504

(56) References Cited

U.S. PATENT DOCUMENTS 3,822,838 * 7/1974 Butler, Jr. et al. ..... 242/417.2
3,949,949 * 4/1976 Thompson ..... 226/30
4,151,594 * 4/1979 Stern ..... 242/421.1
4,214,943 * 7/1980 Stern ..... 156/504
4,709,872 * 12/1987 Hammer et al. ..... 242/421.6
4,750,659 * 6/1988 Maier et al. ..... 101/228
5,186,409 * 2/1993 Kansaku ..... 242/421.6
5,647,276 * 7/1997 Tilton, Sr. ..... 101/219
5,743,184 * 4/1998 Skudrzyk ..... 101/181

* cited by examiner

*Primary Examiner*—Eugene Eickholt
(74) *Attorney, Agent, or Firm*—William H. Maxwell

(57) ABSTRACT

Combined newsprint core brake system and newsprint supply reel in a continuous running roll press, for full and fractional running web supply, web tension sensor control braking coupled to core chucking spindles in the running newsprint roll core position, characterized by selectively activated Zero stroke multi caliper disc brakes carried by multi-armed spiders with core chucking spindles axially positioned and circumferentially spaced for indexing a chucking spindle axis from pre-drive to running newsprint roll core position; eliminating the prior art "transition period" replaced herein by "Constant Tension", eliminating the prior art drag-belt deterioration of the newsprint surface texture; and with assurance of effective roll to roll splicing.

26 Claims, 9 Drawing Sheets

70
67
WS
17
66
69
66
18
68
65
W
b
N
CB
c
40
a
20

A
PD
N

WS
18
77
PD
WPC
N
CB
B
12
R
N
B

W
WS
18
PD
PC
77
CB
B
N
N
B
CB
R
12
B 57
55
B
60
CB
61
R
56
40
56
62
63
50
63
49
45
15
48
P
43
41
42
D
51
47
14
44
15
58
59
12
B

FIG. 12.
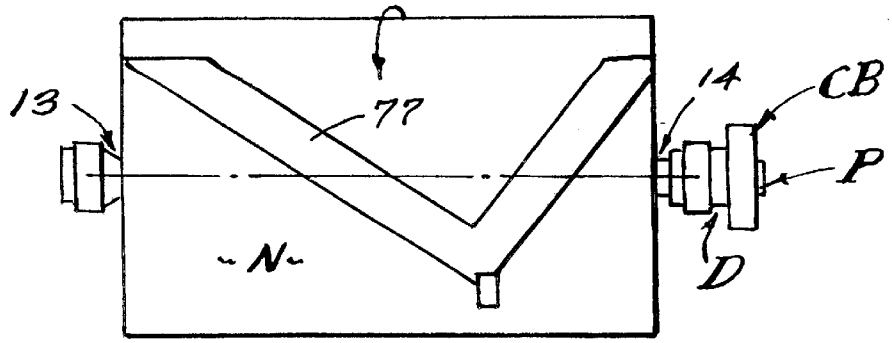
FIG. 13.
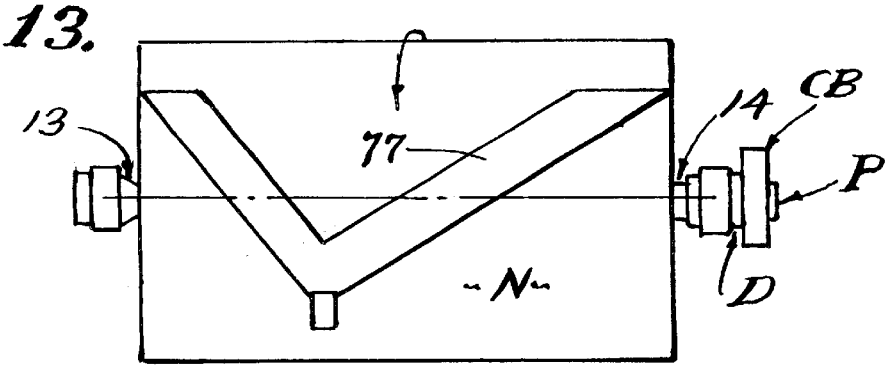
FIG. 14.
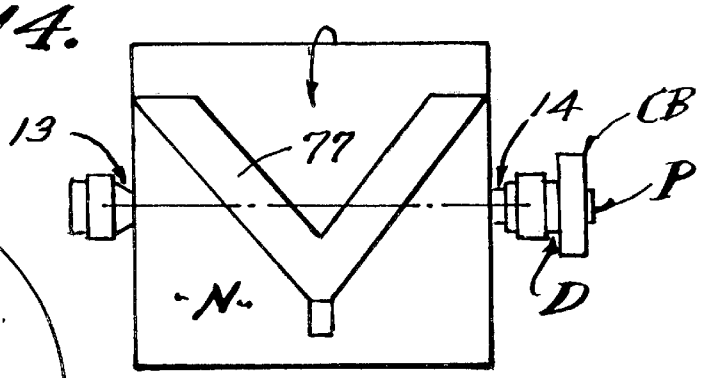
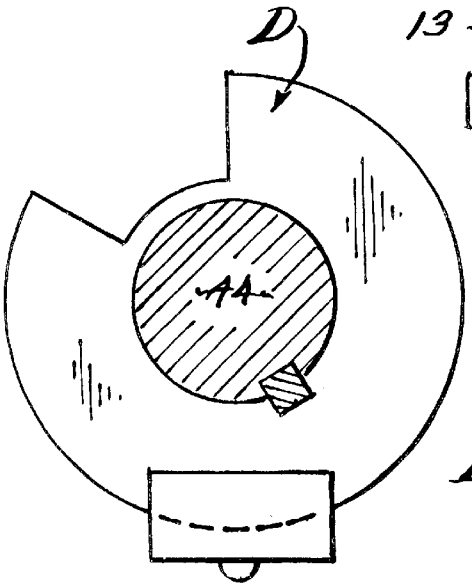
FIG. 15.

NEWSPRINT CORE BRAKE SYSTEM FOR NEWSPAPER PRESSES

BACKGROUND OF THE INVENTION

This invention relates to newspaper presses for supplying continuous high speed newsprint web to the printing couples of newsprint presses. The printing press art, particularly that for color printing, is adversely affected by the present day tension system employing tension belts that "glaze" the newsprint as by planishing or calendering the newsprint underlying said belts, and thereby "streaking" the newsprint surface, it being a general object of this invention to eliminate streaking and leave the newsprint surface virtually untouched and therefore uniform in texture and surface quality.

Newsprint supplied in roll-form is 40 to 50 inches in diameter, and a full roll is 54 inches wide. In practice, the reel apparatus which supplies the newsprint web to the printing press is adjustable so as to accomodate fractional roll widths, i.e. ¼ to full rolls. Therefore, prior art web tension systems are characterized by four identical tension belts, one for each quarter roll. And, each of these belts inevitably "streaks" the web surface to a noticable degree when applied to tension the web. Also, the presence of these belts reduces access to and the effective pasting area required for splicing new web to expiring web.

Prior art web tensioning control systems adversely calender the newsprint as it is supplied to the roll press. This calendering affects some of the fiber ends of the paper pulp which are sheared off and remain as loose particulate upon the newsprint surface, adhering thereto by static electricity. Therefore, when the newsprint reaches and contacts the impression (or blanket) cylinder for transfer of ink and moisture thereto, the "tack" of the ink causes said particulate to stick onto said blanket cylinder, thereby restricting the moisturized ink from the newsprint; and the moisture (water) grounds the static electricity. Consequently, the longer the roll press runs the greater is the particle paper fiber accumulation; and invariably to a degree readily detected by the naked eye. Because the paper dust particles are wiped onto the newsprint by the aforesaid tensioning belts, said particle accumulation is streaked longitudinally of the newsprint aligned with each of said tensioning belts. Heretofore, this dust particle accumulation has required STOPPING the press in order to wash away said accumulation of particulate, but this is only a temporary solution to the problem which reoccurs. It is an object therefore, to provide a system that virtually eliminates said streaking, eliminting STOPPING the press for blanket cylinder washdown and thereby preserving the surface texture and printing properties of the newsprint so that printing quality is maximized.

State of the art newsprint reels are comprised of three-armed spiders adjustably spaced on a central positioning shaft. There is a chucking spider that engages the core of the newsprint roll onto the spindle of a pastor spider that has a "contact point cover" which indicates the rotative position of the installed roll, whereby a splicing area or zone is established. Said rotative position is indicated by a timing pointer to coincide with a position sensing Hall Effect means that electronically senses said rotational position of the newsprint roll at any press speed or velocity, by which the paster brushes and knives are automatically timed to simultaneously splice a new web to an expiring web.

Tension of the newsprint web as it feeds into the printing press is regulated by a state of the art web force sensing roller, a "dancer roller", and by a lever system and air pressure regulator for web tensioning control. It is an object of this invention to apply this regulation to spindle braking applied directly to the core of the newsprint roll. In Accordance with this invention, a spindle braking means replaces each tension belt of the prior art systems.

A prerequisite for splicing a new web to a running web is the pre-drive or acceleration of a new roll to the same velocity as the running roll feeding the web into the press. This pre-drive system is state of the art, and is comprised of velocity sensors responsive to the speeds of the pre-drive belt and of the running web feeding the press. When the pre-drive peripheral speed of the new roll is up to the surface speed of the running web, the system is readied for the splice cycle.

It is an object of this invention to provide a newsprint web tension system with improved web-force control applied without adversely affecting other functions and physical properties of the newsprint. Accordingly, existent web force sensing, pre-drive system, and paster-knife system can remain state of the art, this invention being characterized by a multi-force braking mechanism applied to the core spindle of each of the three paster spider arms of the state of the art newsprint reels. In carrying out this invention, said braking mechanisms are comprised of stators attached to existent spider arms, and rotors attached to and driven by modified core supporting spindles, with brake actuating cyliners and controlled air pressure commutation thereto as required.

The prior art "Predrive" systems lack the sensitivity desired in order to avoid over reaction as well as under reaction, which heretofore has required activating a clutch/brake on the new roll accelerator mechanism that functions when the paster-knife mechanism is fired (actuated). This prior art clutch/brake is required because of the "transition period" during which the tension belts are inactive when transfering engagement from the expired newsprint roll to the new newsprint roll in the process of attachment.

The prior art requires a "transition period" control circuit that causes the "Predrive" to be alternately energized and de-energized, and/or re-energized etc., resulting in variable tension and particularly the misregistration of color printing. Consequently, it is not unusual for 350 to 700 full copies of a newspaper to be unacceptable; but these are not always discarded and the paying Advertisers complain about the significant number of poorly printed color adds that are arbitrarily delivered to the readers. Some newspapers throw away about 50 papers before and after a splice, but this is not commonplace. Previous presses ran slower and allowed the pressman to manually intercept the product stream and discard "waste"; but not so with state of the art printing establishments where the pressmen are housed in "quite rooms" and operate the presses remotely. All the good and bad is sold and the Advertisers continue to complain, it being an object of this invention to eliminate poorly printed advertising.

The typical prior art newsprint feed system operates as follows: After the paster-knife mechanism fires and while the Predrive belt is in contact with the new roll, but the new roll not yet in contact with the tension belts, the only means to stop the new roll in an emergency is with the clutch/brake and its control circuit. Accordingly, there is an electrical bypass set at a pre-set resistance in the brake control circuit so as to pass high braking current to the brake for this type of Emergency Stop (E-STOP). This control circuit is set to a fixed voltage value based upon the average mass which is equal to half of the newsprint mass running at a normal press velocity. However, this prior art control circuit does not compensate for smaller or larger width and/or diameter rolls, nor for changes in press velocity. Therefore, the same braking used for a ½ roll is arbitrarily used for a ¼, ¾ and full roll, for an E-STOP during the transition period, which results in abrupt changes in web tension and which often causes the web to break. Since it is common that a press starts with multiple rolls of the same nominal diameter, multiple splices can occur together. And, if any roll splice is "missed" an E-STOP results; several rolls can be in the transition period herein referred to. This occurs more often than one would expect, and usually results in a web break on any roll that is within said transition period; other than a ½ roll which is compatible with the average mass brake setting of the control circuit.

It is an object of this invention to instantaneously control core spindle "drag" whereby control is not delayed and web tension is not adversely affected. In other words, the conventional "transition period" is virtually eliminated, which is made possible by retraction of the new roll accelerator and instantaneously transfering control to Zero Stroke disc-brake calipers immediately responsive to air pressure variations dictated by the dancer roller. With the present invention, when the paster-knife fires there is little or no change in running web tension nor velocity change, while normal variations are instantaneously reflected as variable air pressures applied to the instantly responsive core spindle brake calipers controlling the new running roll.

It is an object of this invention to replace each prior art roll tensioning belt and long stroke air cylinders with a drag brake caliper applied directly to the running roll core spindle. It is also an object to apply drag braking to the expiring roll as well as the new running roll, whereby the expiring web and new running web have tension control thereof prior to and immediately after the pastor-knife mechanism fires. It is also an object to apply drag to the core spindle of the new newsprint roll, so that transition from the paste position into the running roll position is not adversely affected after firing the paster-knife mechanism. Consequently, there is no so-called "transition period"! With the system herein disclosed, the newsprint rolls do not run over speed nor under speed, and re-acceleration is never required, thereby eliminating alternate slack and excess tension variations and misregistration in roll press color printing.

An object of this invention is to apply core spindle drag commensurate with newsprint roll width. That is, each quarter width of a roll is subject to an initial drag value. Accordingly, each spindle brake disc is engaged by a multiplicity (four) of distinct brake calipers, one activated for each quarter of the newsprint roll carried by the spindle. A control feature is the variable drag brake caliper pressure responsive to running web tension sensed by the "dancer roller". And a fifth and sixth brake caliper provided for stopping the expired roll and for emergency STOP of the press functions.

It is an object of this invention to provide a newsprint roll supply for continuous press operation wherein the prior art tension belts and air cylinders are replaced by electrical drag brake selection whereby the press operator switches to the proper roll width, without the necessity of mechanically demobilizing one or more tension belts and associated air cylinders. As herein disclosed there are six disc-brake calipers at each newsprint core spindle, of which there are four one quarter width calipers, and a fifth and sixth caliper added for control and expired roll core braking when a splice is executed and all six calipers used. When the paster-knife mechanism fires, the core braking caliper or calipers continue to be applied to the expired roll to stop its rotation, as the pre-drive mechanism is deactivated, and the web tension instantaneously applied to the new running newsprint roll for consistant register in the press. Web tension control in instantaneously applied to the new roll by the air pressure dictated by the dancer roller and also sent to stop the expired roll so as to prevent paper spill. In order to stop the expired roll momentum quickly, the fifth and sixth brake calipers are activated, thereby eliminating the need for said prior art high cost—high maintenance electric core brake. When the new roll is indexed into running roll position the expired roll fifth and sixth air brake calipers are deactivated and the core spindle is ready for reloading a new roll. The paster-knife mechanism is retracted as the core brake calipers have continued tension control governed by the dancer roller without interruption (not by the clutch/brake of the prior art). In prior art systems when the new roll is in the Predrive mode or in the transition period, in an emergency the new roll must be stopped by applying the clutch/brake, which if in the prior art transition mode results in exaggerated tension, spilling of paper and web severing.

This new system is directly related to air pressure input to the core brake calipers responsive to the web tensioned dancer roller that determines the brake activating air pressures, resulting in constant torque control including emergency stops or any other mode. The prior art clutch/brake's emergency stop function is replaced by the aforesaid six brake calipers at each core spindle, there being no change in press operation to control and stop the press. The prior art clutch/brake's remaining function of maintaining press velocity of the new roll in the predrive mode is retained. The disc-brakes herein disclosed are air cooled with a stopping time from 2200 ft/min. with a 2000 pound newsprint roll of 6 seconds @ 70 psig. using five of the calipers.

SUMMARY OF THE INVENTION

Newspaper printing presses are continuous running roll presses wherein sequential newsprint rolls are supplied from a reel apparatus characterized by a running roll spindle axis, an expired roll spindle axis, and a new roll spindle axis. These three spindle axes are circumferentially spaced about a center positioning shaft so as to be indexed into and retracted from the running web positions. The web velocity of the press varies but is normally constant. However, there are discrepancies in the newsprint roll configuration, resulting in slight but significant velocity changes in the running web that feeds off the periphery of the feed or supply roll. Accordingly, a web-force sensing dancer roller is applied to the running web intermediate the feed roll and the press, and by means of a lever system variable air pressure is applied to braking cylinders which apply corresponding variable braking force to brake calipers that frictionally engage the rotor of a disc-brake driven by the aforesaid spindle. This newspaper roll spindle braking system is duplicated at each of the aforesaid reel axes, each of which progressively assumes one of the "pre-drive", "running roll", "expired roll" and "new roll" positions. It is the long stroke air cylinders and the tension belts attached thereto, and the emergency STOP function of the predrive cluth/brake during the prior art transition period which this invention eliminates, and substituting therefor this invention provides instantaneously responsive core spindle air braking commensurate with web tension requirements. The prior art "transition period" is rendered non-existent and is replaced by "braking" instantaneously transferred from the expiring roll to the new running roll of newsprint when the paster and knife mechanism is fired to establish a new running roll splice instantly subjected to the prevailing running web tension. Streaking and pleating of the newsprint heretofore caused by the prior art tension belts resulting in illegible printing with "voids" is virtually eliminated, whereby acceptable quality printing is produced.

The foregoing and various other objects and features of this invention will be apparent and fully understood from the following detailed description of the typical preferred forms and applications thereof, throughout which description reference is made to the accompanying drawings.

THE DRAWINGS

FIGS. 12 through 14 are elevational views of the backside (same as FIG. 1) of the newsprint rolls, illustrating typical makeup configurations of the glue patterns, FIG. 12 showing a ¾ roll carried by a support spindle positioned at the left side of the roll press and secure to a chucking spindle at the right, FIG. 13 showing a ¼ roll secure to the chucking spindle positioned at the right of the roll press and carried by the support spindle at the left, and FIG. 14 showing a ½ roll secure to the chucking spindle positioned to the right of the roll press and carried by the support spindle midway between opposite sides of the roll press.

Note that the prior art tension belts are absent and that the peripheral faces of the newsprint rolls are completely exposed and in no way impared. Also note the presence of the Core Braking System CB as shown.

Figure 11:
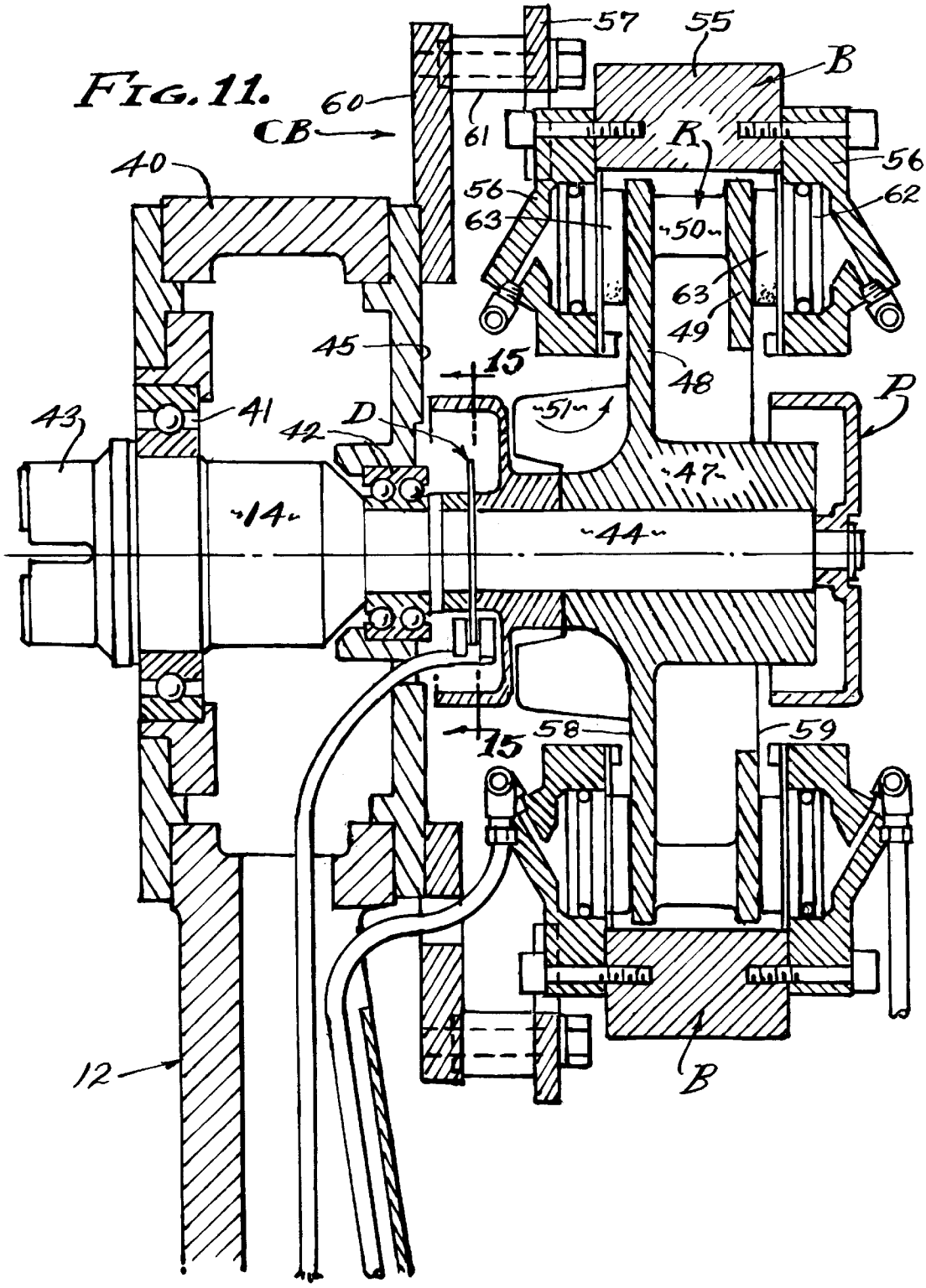
FIG. 11 is a cross section at the outer reach of one of the three core driven chucking spindles, illustrating the modified core spindes of the disc brake unit carried thereby and comprised of a multiplicity of six (6) pairs of caliper brake means, as will be described.

And, FIG. 15 is an enlarged sectional view of the Hall effect disc and sensor, taken as indicated by line 15—15 on FIG. 11.

PREFERRED EMBODIMENT

The prior art Newsprint Reel R, Pre-Drive PD, Paster-Cutter PC, and Web Tension Sensor means WS are employed herein as an integral part of the Newspaper Roll Press (not shown) to which the Newsprint Core Brake System CB of the present invention is adapted in order to provide improved and reliable printing press performance at reduced cost.

State of the art Reel systems accommodate newsprint N rolls 50 to 57 inches wide and 40 to 50 inches in diameter, adjusted to compensate for irregularities and web misalignment, with provision for loading new rolls and removal of expired rolls.

This Newsprint Core Brake System CB working in conjunction with state of the art Reels, automatically controls tension in the running web W of newsprint, without encumbering, interfering with, touching nor degrading the newsprint N supply roll. This System accomodates running of any standard full roll, half roll, three-quarter roll, and a one-quarter roll. The state of the art paster-cutter PC affords the pressman control of a splice of a new roll of newsprint N to an expiring web W thereof, the splice being made without stopping the press, and without reducing velocity. And when an expiring newsprint N roll reaches a minimum diameter, a sensor means (not shown) detects an expiring roll and sequentially initiates a "Position Phase", a "Pre-Drive Phase", and a "Paste and Cut Phase", resulting in splicing a new roll of newsprint N to the expiring running web W thereof. A feature of this invention is the instantaneous splicing of the new roll of newsprint N to the cut-off end of the continuously running web W of newsprint N, with little or no change in web velocity and tension thereof. The prior art "transition period" is eliminated.

The Newsprint Reel R has a central shaft 10 on an indexing axis a from which transversely spaced three-armed core chucking spiders 11 and 12 project to support individual newsprint N rolls on circumferentially spaced axes b, c and d disposed radially from and parallel to axis a. Rolls of newsprint N chucked on rotatable ball-bearing mounted spindles 13 and 14 that extend into the opposite open ends of the roll cores C. The spindle axes b, c and d are indexed smoothly into position for loading, make-up, and subsequent feeding into the couples of the roll-press by an indexing motor drive means 15. The motor drive 15 means includes a magnetic brake so that the reel can be stopped instantly in selected rotative positions. In practice, the reel R is indexed to a required position by forward or reverse operation of the motor drive 15. The cores C of expired web rolls are removed and replaced by new rolls of newprint N, onto either of the spindle axes b, c and d during a press run or when the press is stopped. A hydrualic margin control system 16 permits the spaced reel arms 11 and 12 to be moved as a unit horizontally in either direction for sidelay positioning, carrying therewith the Newsprint Core Brake System of the present invention.

The Newsprint Core Brake System CB of this invention is comprised, generally, of brake means B responsive to the Web Tension Sensor Means WS, and associated controls. This system accomodates running web tension variations and normal as well as emergency stops. Web tension is maintained substantially constant so as to feed newsprint to the roll-press couples without adversely affecting registration and without the danger of breaking the web.

In accordance with this invention, web tension is controlled by means of a multiplicity of brake calipers frictionally restraining the running web core spindle feeding the newsprint web. The calipers brake the running core spindle in proportion to regulated force exerted by disc-brake pads. The core C upon which the newsprint roll revolves is drivably chucked to the free turning core driven spindle 14, the newsprint core C being chucked between the spaced coaxial free turning spindles 13 and 14.

Figure 2:
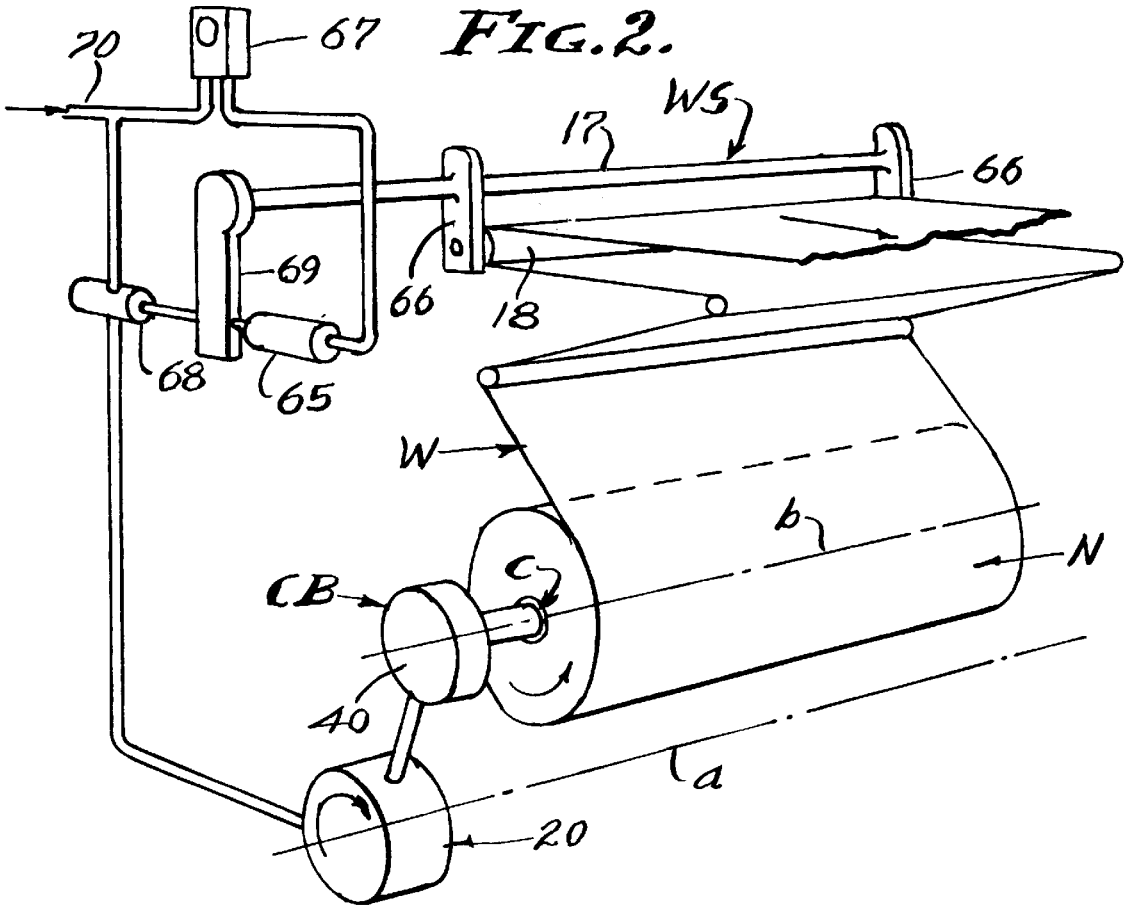
FIG. 2 is a diagrammatic perspective view of the prior art regulated air pressure system subject to running web tension.
Figure 3:
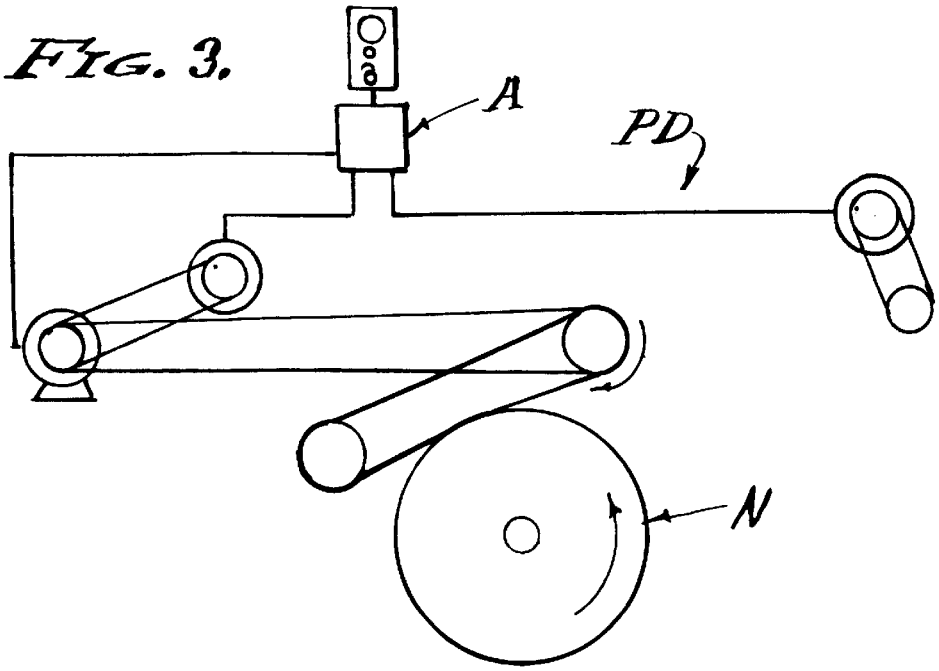
FIG. 3 is a diagrammatic elevational view of the prior art pre-drive and velocity control system, positioned to accelerate a New Roll of newsprint.

Referring now to FIG. 2 of the drawings, the Web Tension Sensor Means WS involves a pivot shaft 17 that rotatably carries a "dancer roller" 18 disposed transversely in an extensible loop of the running web W before it feeds into the couples of the roll-press. The variable extent of said loop of the running web W causes the dancer roller 18 to swing to and fro from the feed end of the roll-press, thereby regulating an air pressure supply, later described, that applies regulated air pressure to the pistons of a multiplicity of brake calipers, as will be described. These air pressure regulated brake calipers govern the necessary variable restraint applied to the core C of the running supply roll of newsprint N.

Figure 10:
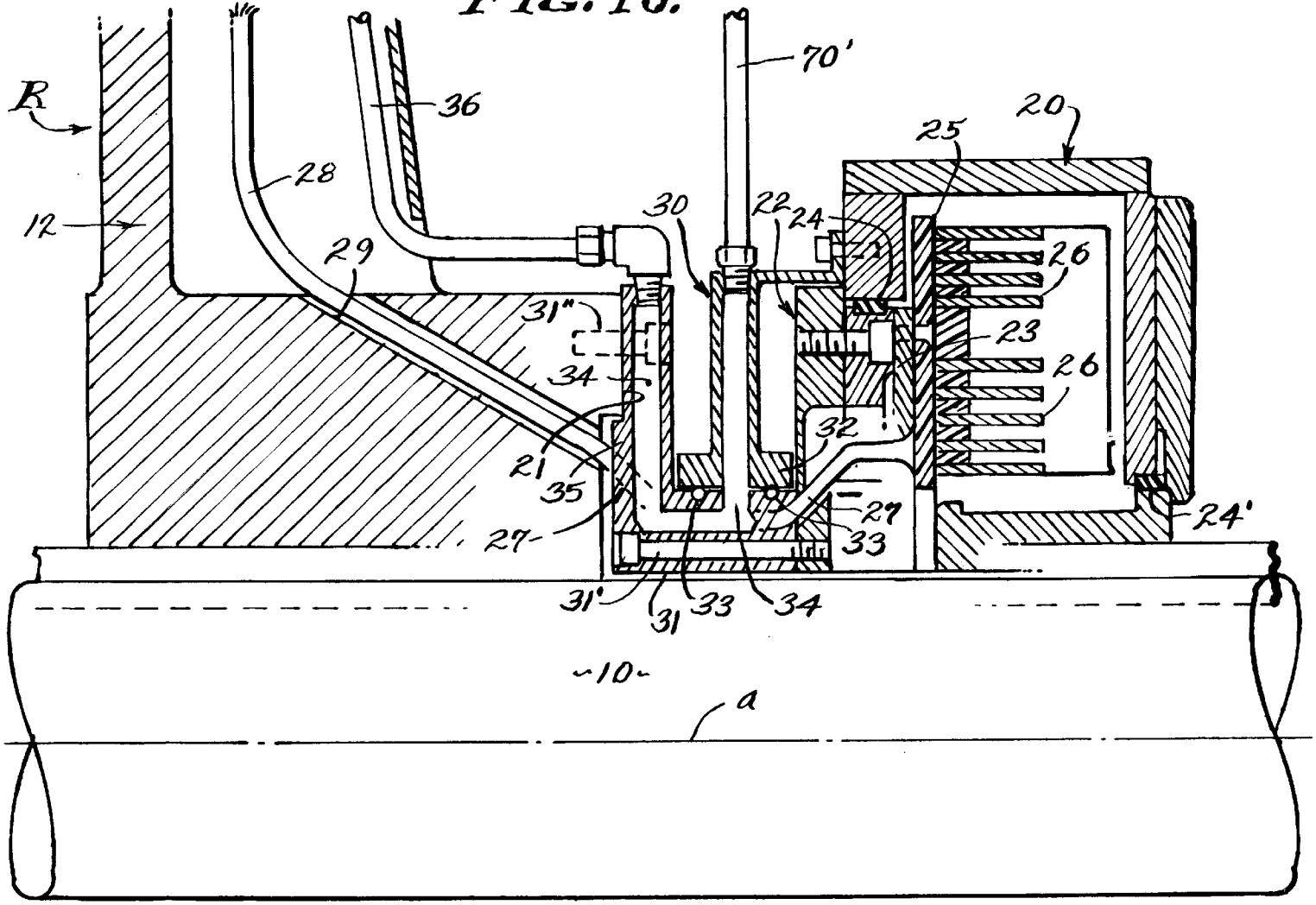
FIG. 10 is a fragmentary cross section taken at the central axis of the reel, illustrating one of the spider arms adapted to transport fluid pressure for operating the caliper brake means herein disclosed.

Referring now to the reel R and to FIG. 10 of the drawings, it is primary object of this invention to provide an after-market Newsprint Core Brake System CB adaptable to existent roll-presses with a minimum of change thereto. Accordingly, the supporting reel shaft 10 on axis a is employed without change, utilizing existent spiders 11 and 12, and an existent stationary member 20 with slip-ring commutation for electrical controls. As shown, the stationary member 20 is spaced from the hub face 21 of the spider 12, between which this invention provides an adapter 22 and a rotary union 30.

The adapter 22 is affixed to an extistent slip-ring holder 23 that rotates with shaft 10, with peripheral seals at 24 and 24' to turn within said stationary member 20. The slip-rings per se are concentric conductors carried by an insulator plate 25 rotating with the shaft 10, and electrical contact therewith is by means of complementary stationary brushes 26, as shown. This adapter 22 is affixed to rotate with shaft 10 as by means of cap-screws 31' secure to a sleeve member 31 affixed to face 21 by cap-screws 31". There is a longitudinal passage 27 extending through the sleeve member 31 and open between the slip-rings within the stationary member 20 and the hub face 21, through which a multi-conductor cable 28 extends into the spider 12 via a runway 29.

Figure 8:
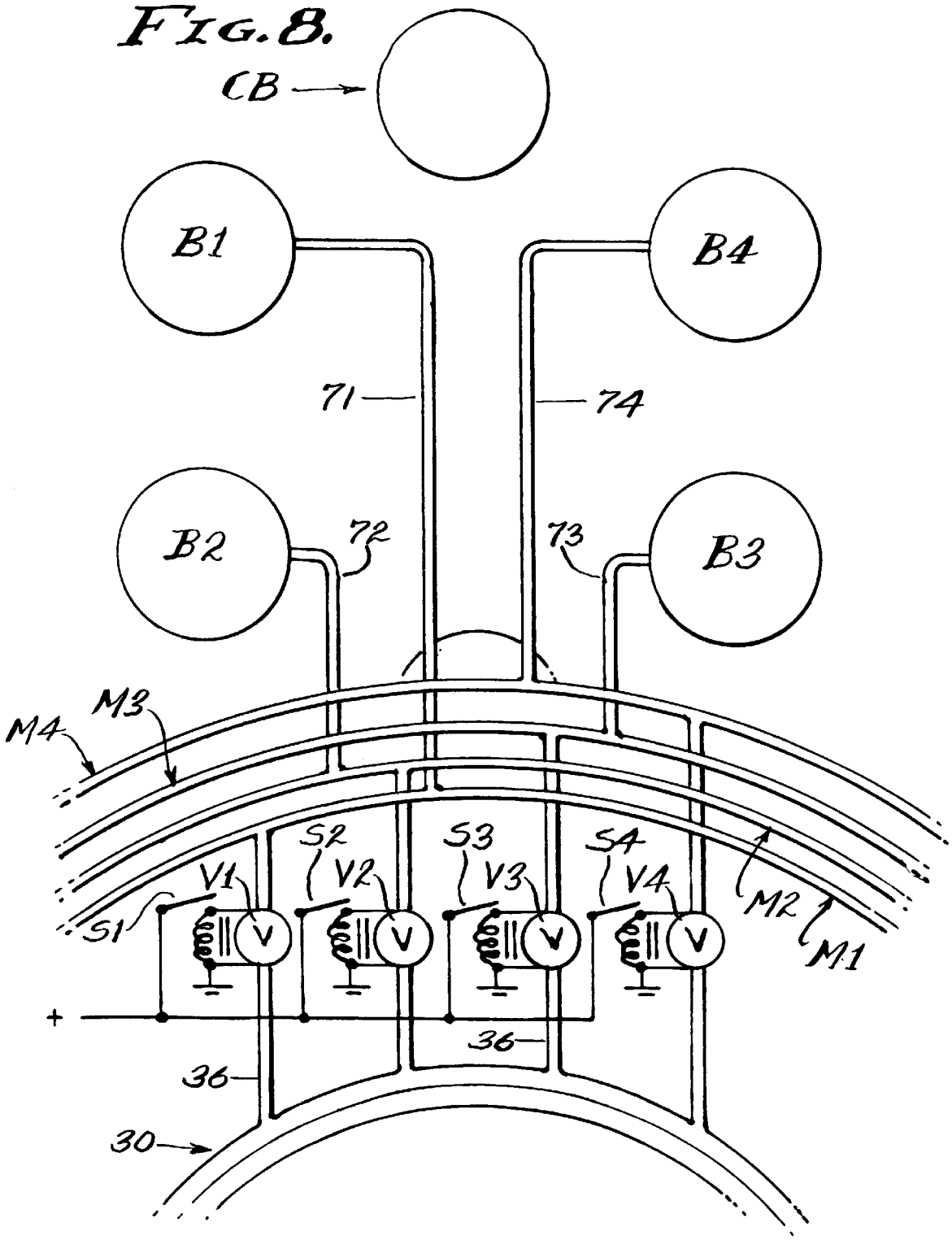
FIG. 8 is a combined pneumatic and electrical diagram at each of the three arms of the reel, illustrating the collective application of the core spindle braking calipers subject to the tension responsive system of FIG. 2.
Figure 9:
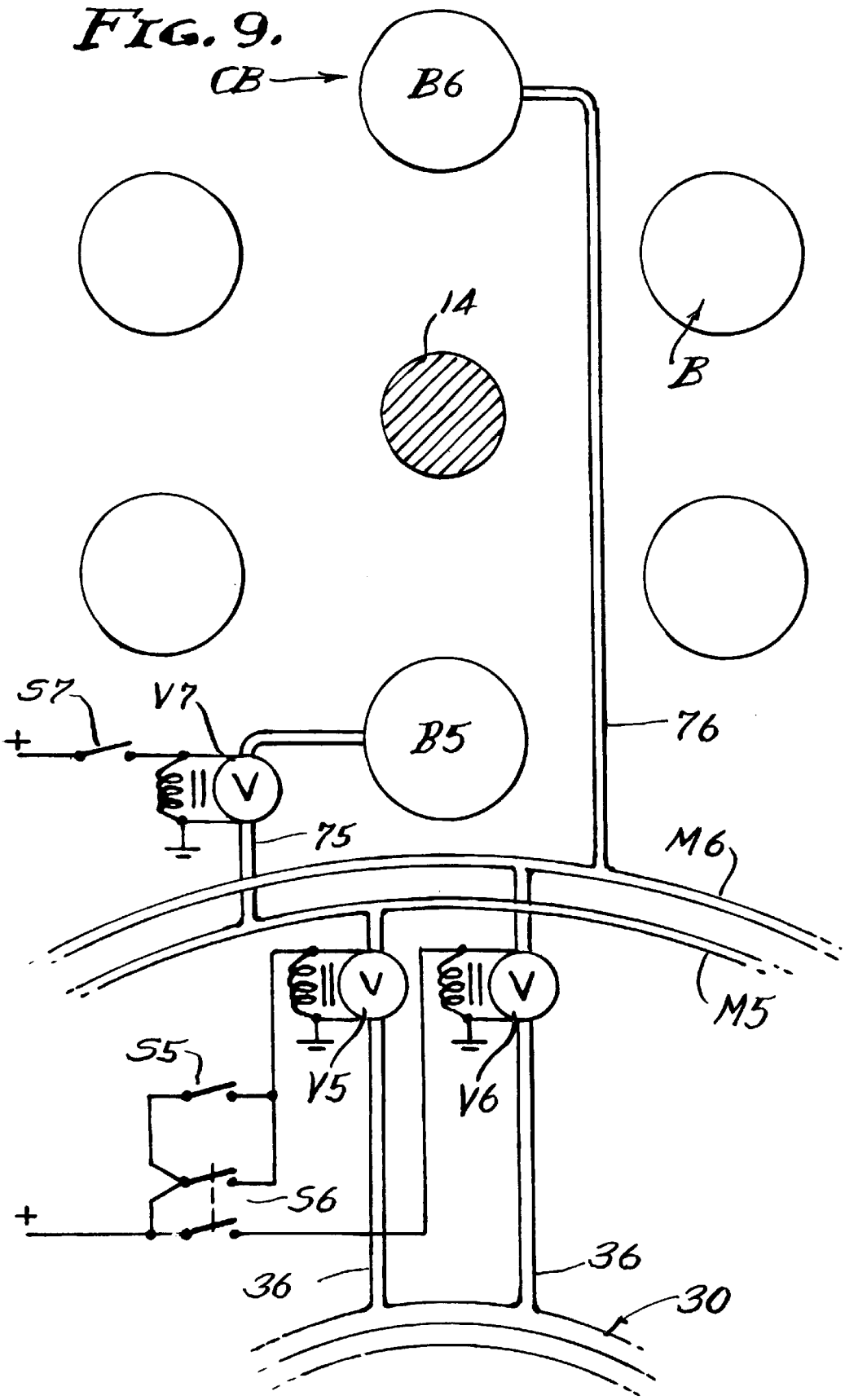
FIG. 9 is a view similar to FIG. 8, at each of the three arms of the reel, illustrating the selective application of braking pressure to the running and emergency stop braking calipers.

The rotary union 30 is comprised of two relatively rotatable members 31 and 32 affixed to the stationary member 20 and rotatable hub face 21 respectively. The member 32 is a collector ring with a cylindrical bore engaged with axially spaced seals 33 embracing a fixed passage 34 open radially from an outer cylinder wall of the inner member 31 that rotates with the spider hub face 21 and shaft 10. The sleeve member 31 is carried by a flange 35 affixed to the face 21 of the spider hub, there being a radial continuation of the port-passage 34 therethrough, as shown. In accordance with the preferred embodiment of this invention, the core brake CB is pneumatic, in which case regulated air pressure is supplied through the aforesaid port-passage 34 in and through sleeve member 31, and distributed from passage 34 through an air line 36 extending to the multiplicity of air brake calipers B with solenoid control valves and switching as shown in FIGS. 8 and 9. The shaft 10 extends adjustably between the spiders 11 and 12, and projects to the indexing motor drive 15, all without change to existent roll-presses, except for the additions hereinabove described.

Referring now to the Newsprint Core brake system CB and to FIG. 11 of the drawings, it is an object of this invention to provide an improved after-market web tensioner system that replaces the prior art belts (not shown) and entirely eliminates damaging contact with the periphery of the running roll of newsprint. However, the Core Brake System CB remains compatible with existent prior art Web Tension Sensor Means WS, Pre-Drive PD and Paster-Cutter means PC, these three means being employed herein substantially without change. This core brake system CB can be embodied in any one of a variety of drag mechanisms adapted to restrain torque applied to and by the rotating core of the newsprint N by the web W, for example by a variable torque hysteresis brake, or a hydraulic torque converter, or drum brake or the like. In its preferred form herein disclosed the core brake system CB is a disc and caliper braking system that directly restrains torque at the newsprint core on any one of the axes b, c or d. Preferably a multiplicity of brake caliper assemblies B, each with a distinct function for conventional control of the prior art roll-press operation, but devoid of the aforesaid tension straps.

The core brake system CB is adapted to existent roll-presses with a minimum of change thereto, the core driven spindle 14 carried by the spider arm 12 being extended, and the prior art electric core brake being removed from the housing 40 and eliminated and/or discarded. Accordingly, the housing 40 at the outer reach of each arm of the spider 12 passes the spindle 14 rotatably carried therethrough by spaced anti-friction bearings 41 and 42 journaled in said prior art housing 40 on each of said axes b, c and d. A core chuck 43 projects inwardly along each core axis and each spindle 14 is extended at 44 from the housing face 45 so as to carry the additional rotor R, the Hall-effect disc and complementary Paster-Position Indicator P as will be described. Essentially therefore, a single replacement member in the form of an extended core-driven spindle 14 is provided by this invention. The disc-brake rotor R rotates with the core driven spindle 14 responsive to variations in web velocity. It is to be understood that the running newsprint roll is carried on any one of the axes b, c or d indexed to various positions and particularly into the running positions shown in FIGS. 4, 5 and 6.

The brake rotor R is comprised of axially spaced disc members 48 and 49 carried by a hub 47 keyed to spindle 14. The inner member 48 is integral with the hub 47, whereas the outer member 49 is detached therefrom and cantilevered from member 48 by a circumferential series of air pump vanes 50, the member 49 having an inner diameter concentric with and spaced from hub 47 thereby providing an air induction passage for airflow between the opposed radial faces of the disc members 48 and 49. Additional cooling air flow is induced by a circular series of air pump vanes 51 projecting inwardly from the rotor R for inducing air flow radially over the inner face of disc member 48.

In accordance with this invention, there is a brake caliper assembly B for each of the aforesaid functions of tensioning the web W of any number of the four running web sections of newsprint, and to provide for a normal "Running Stop", and to provide for an "Emergency STOP". In practice, at least one brake pad caliper assembly comprised of a header 55 carrying axially spaced cylinder blocks 56 is positioned by a carrier plate 57 to embrace inner and outer friction faces 58 and 59 of the rotor R, there being a multiplicity of six (6) brake caliper assemblies (more or less) at the core spindle 14 at the spider arm 12 at each axis b, c and d. Each unit of six brake B calipers is carried by an adapter plate 60 secured to the housing face 45 of the spider arm housing 40 and positioned by spacers 61 secured by cap screws to said housing. The cylinder blocks 56 at each header 55 are coaxial with "Zero Stroke" pistons 62 engageably actuating brake pads 63 juxtaposed against and to frictionally engage faces 58 and 59 of the rotor R. In practice, the brake pads 63 kick-back 0.005 to 0.010 inch when cylinder pressure is released, due to movements of the rotor R, said kick-back clearance being noticable and at times substantially non-existent. Therefore, the brake B calipers are substantially devoid of lost motion and are thereby instantaneously responsive to the Web Tension Sensor Means WS and operable to apply frictional braking for restraining velocity of the running web W before its entry into the couples of the roll-press.

Referring again to FIG. 2 of the drawings and to the Web Tension Sensor Means WS, a loading cylinder and piston means 65 applies an adjusted reference air pressure to spaced levers 66 shiftably carrying the dancer roller 18 from the pivot shaft 17. This reference air pressure is set with an adjustable regulator 67 to correspond with the anticipated running web tension requirements, and is re-adjustable. The adjusted reference air pressure is balanced against a cylinder and piston means and air regulator valve 68, with an impulse lever 69 on shaft 17 seeking equilibrium between said means 65 and 68. Proper web tension is obtained when these cylinder and piston means are balanced, thereby positioning the impulse lever 69, so that the air regulator valve 68 will control the core brake system CB from a regulated air pressure supply 70. In practice, the regulated air supply pressure at 70 is within a range of 10 to 75 p.s.i.

Referring now to FIG. 8 of the drawings and to the basic air pressure distribution to the brake caliper means B1, B2, B3 and B4, the air pressure from regulator valve 68 controls the flow of air to and fro through the rotating union 30 for collective distribution through air lines 36 to each one of the solenoid actuated air valves V1, V2, V3 and V4. Each of said valves is normally closed and actuated to open by closing a complementary switch as shown and located as circumstances may require. Each of said air valves is connected to a circular manifold line M1, M2, M3 and M4 respectively, extending to each of the three spider arm axes b, c and d, where individual lines 71, 72, 73 and 74 extend from said manifolds lines respectively, to corresponding brake caliper means B1, B2, B3 and B4. Accordingly, any designated one or group of the four brake caliper means can be actively open to the air pressure emanating from the regulator valve 68 controlled by the shiftable dancer roller 18.

Referring now to FIG. 9 of the drawings and to the "Stop", "Running Stop" and "Emergency STOP" capabilities of this core braking system CB and its selective air pressure distribution to the brake caliper means B5 and B6, the air pressure from regulator valve 68 controls the flow of air to and fro through the rotating union 30 for collective distribution through air lines 36 to each one of the solenoid actuated air valves V5 and V6. Each of said valves is normally closed and actuated to open by closing a "Stop", "Running Stop" or an "Emergency STOP" switch as may become necessary. Each of said solenoid valves is connected to a circular manifold line M5 and M6 respectively, extending to each of the three spider arm axes b, c, and d where individual air lines 75 and 76 extend from said manifold lines respectivly, to corresponding brake caliper means B5 and B6.

For normal operation, caliper brake means B5 is the "Running Stop" brake actuated independently or collectively with the aforementioned at least one, two, three or four caliper brake means B1–B4 for simply stopping or bringing a running web feed roll of newsprint to a normal "Stop". Alternately, the caliper brake means B6 is the "Emergency STOP" brake actuated collectively with the aforementioned at least one, two, three or four caliper brakes and with brake caliper B5. Accordingly, one or both brake caliper means B5 and B6 can be actively opened to the air pressure from the regulator valve 68.

Selective control of the regulated air pressure supply to the brake caliper means B1–B6 is by means of the switches associated with complementary solenoid valves V1–V6 (see FIGS. 8 and 9). In practice, said switches are remote from their associated valves and positioned convenient to and for operation by the pressman. The "Emergency STOP" switch is particularly accessible at one or more locations! A feature is the collective pressurization of each one of a plurality of caliper brake means B1–B6, there being a manifold M1–M6 for each plurality of said calipers. In practice therefore, each plurality of calipers is serviced by a single solenoid valve through a common manifold thereto. Accordingly, each plurality of (three) caliper brake means B1–B4 is individually activated by a delegated switch as clearly shown in FIG. 8. And in accordance with this invention, the caliper brake means B5 and B6 are selectively operable by means of a Running Stop switch S5 and an Emergency STOP switch S6 as clearly shown in FIG. 9. The switch S5 individually activates the plurality of caliper brake means B5, the same as with respect to calipers B1–B4. However, a greater braking force is provided for an Emergency STOP by simultaneously activating the caliper brake means B5 and B6, there being a double circuit normally open switch S6 with separate conductors to and for simultaneous operation of respective solenoid valves V5 and V6. Accordingly, the caliper brake means B5 is operable independently for a Glue Paster Pattern Stop, or a Running Stop; or the caliper brake means B5 and B6 are operable together for an Emergency STOP.

System Operation

A feature of the present invention is that state of the art web tension control remains substantially unchanged. In an unbalanced loading cylinder and web force condition: If the web tension is less than required, the web force on the dancer roller 18 is less than the loading cylinder force upon the impulse lever 69. As a result, the loading cylinder shifts the impulse lever to tighten the web loop over the dancer roller, causing the air regulator valve 68 inlet port to open to the brake caliper means B1–B4, resulting in restraining force exerted upon the rotor disc R and directly to the newsprint core C, thereby increasing web tension upon the expiring roll of newsprint N.

When the web tension is increased sufficiently, the web loop force upon the dancer roller 18 exceeds the loading cylinder force imposed upon the impulse lever 69, and the dancer roller 18 shifts toward a balanced position causing the air regulator valve 68 inlet port to close with the web tension at the required value.

In an unbalanced loading cylinder and web force condition: If the web tension is greater than required, the web force on the dancer roller 18 is greater than the loading cylinder force upon the impluse lever 69. As a result, the web force shifts the dancer roller to loosen the web loop over the dancer roller, causing the air regulator valve 68 exhaust port to open for discharge of air from the brake caliper means B1–B4 removing restraint by the rotor disc R upon the newsprint core C, thereby decreasing web tension to the expiring roll of newsprint N.

When the web tension is decreased sufficiently, the loading cylinder force upon the impulse lever 69 equals the web loop force on the dancer roller 18, causing the dancer roller 18 and impulse lever 69 to shift into the balanced position, and the regulator valve exhaust port closed with the web tension again at the required value.

Figure 4:
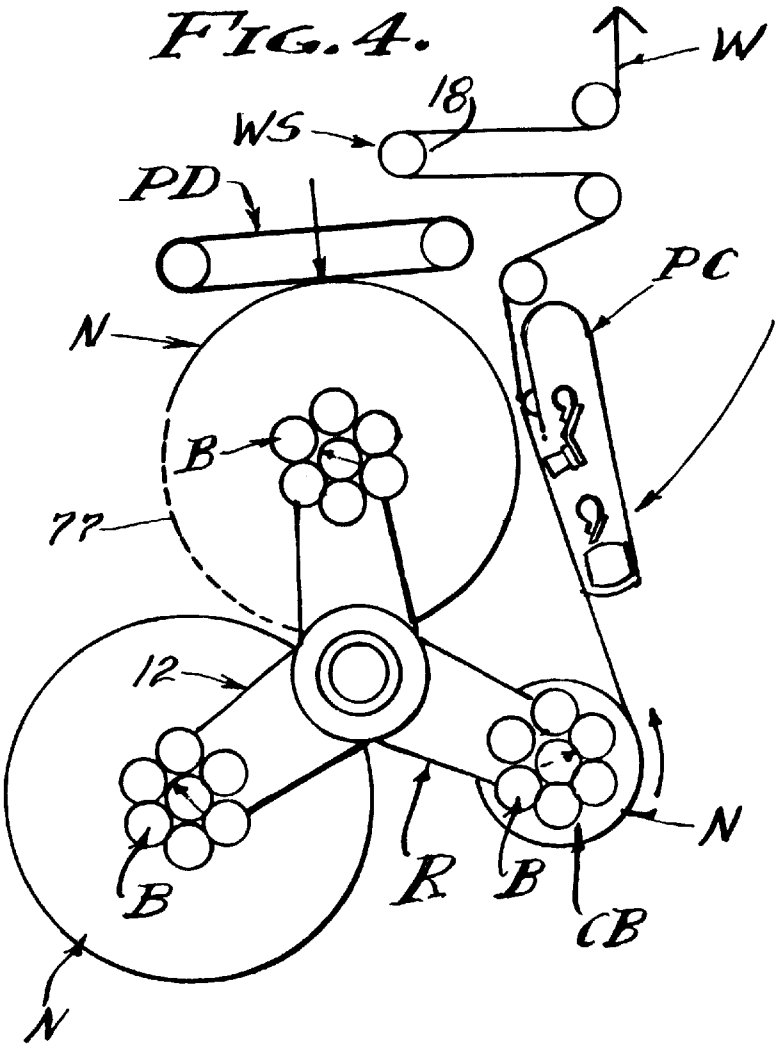

The POSITION PHASE shown in FIG. 4 is when the expiring roll is nearly depleated. Accordingly, the reel R is indexed by means of the motor drive 15 into close proximity to the running web W. And, the carriage of the paster-cutter PC is lowered into proper splicing position, and the pre-drive belt into contact with the surface of the new roll of newsprint N with its "Makeup" glue pattern 77 aligned with the arrow on its corresponding contact cover P.

Figure 5:
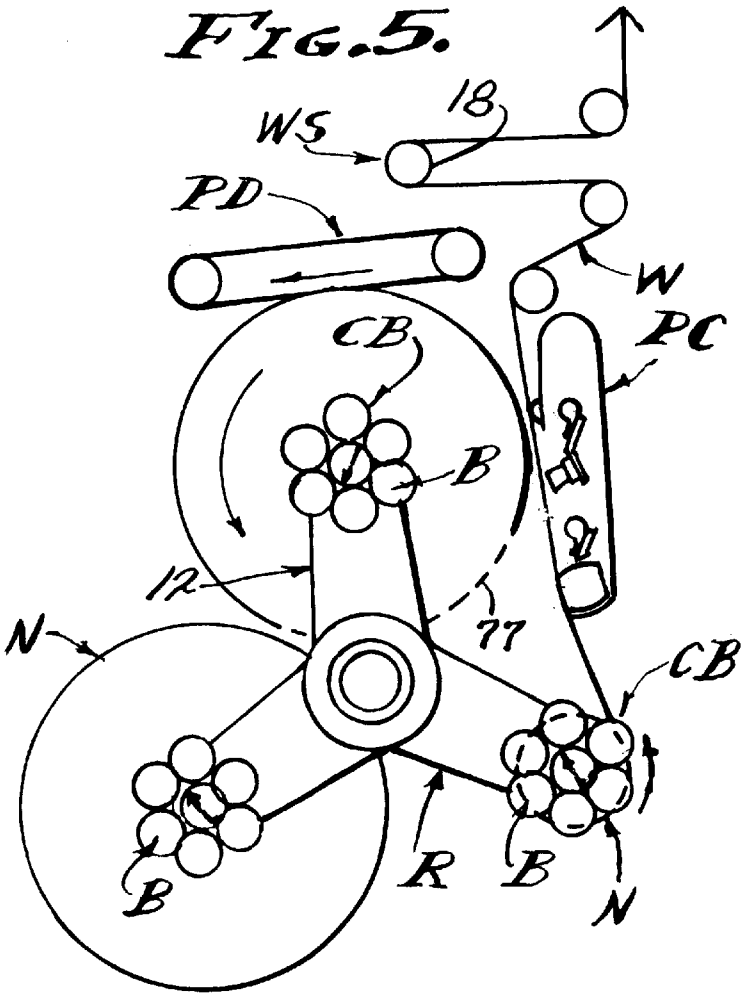
FIGS. 4 through 7 are diagrammatic views illustrating the principal functional positions of the three core axes with the core braking system of the present invention applied to each core axis, FIG. 4 showing the "POSITION PHASE", FIG. 5 showing the "PRE-DRIVE PHASE", FIG. 6 showing the "PASTE PHASE", and FIG. 7 showing the "RUNNING PHASE".

The PRE-DRIVE PHASE shown in FIG. 5 is when the expiring roll is substantially depleated. Accordingly, the pre-drive means PD is operated to accelerate the new roll of newsprint N up to the running velocity of the expiring web W. Tachometer generators at the pre-drive and folder of the roll press respectively, relay corresponding velocity information to an electronic computer A that compares said velocity information and controls the Pre-Drive PD accordingly, thereby maintaining the new roll at the web velocity of the expiring roll.

Figure 6:
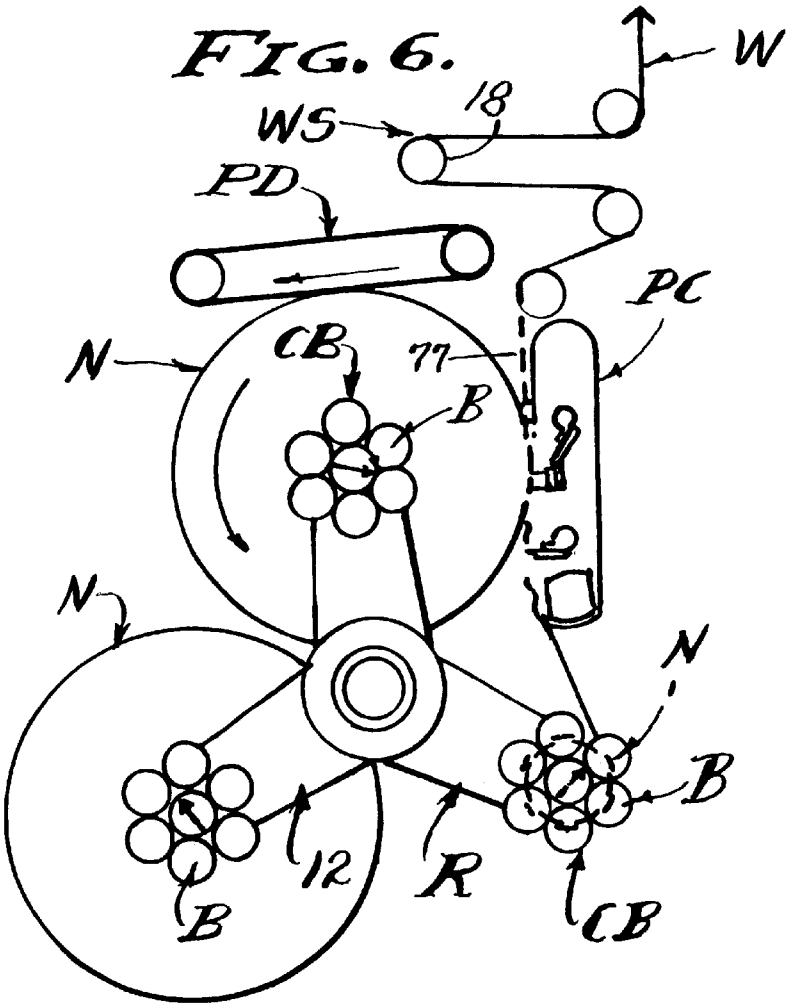

The PASTE PHASE shown in FIG. 6 is when the new roll of newsprint N is spliced to the expiring running web. Accordingly, the brushes are advanced, pressing the expiring web W against the running surface of the new roll of newsprint N. The knives are then activated to sever the tail of the expiring roll as and when the paste pattern revolves into the proper splicing position. Timing is triggered by the Hall effect disc D with its window rotatably aligned with the arrow on the face of the contact cover P, as shown throughout the drawings. The paster-cutter PC is immediately retracted and the expiring roll is immediately braked by operation of the Running Stop caliper brake means B5. This sequence is timed by state of the art electronic computer.

Figure 7:
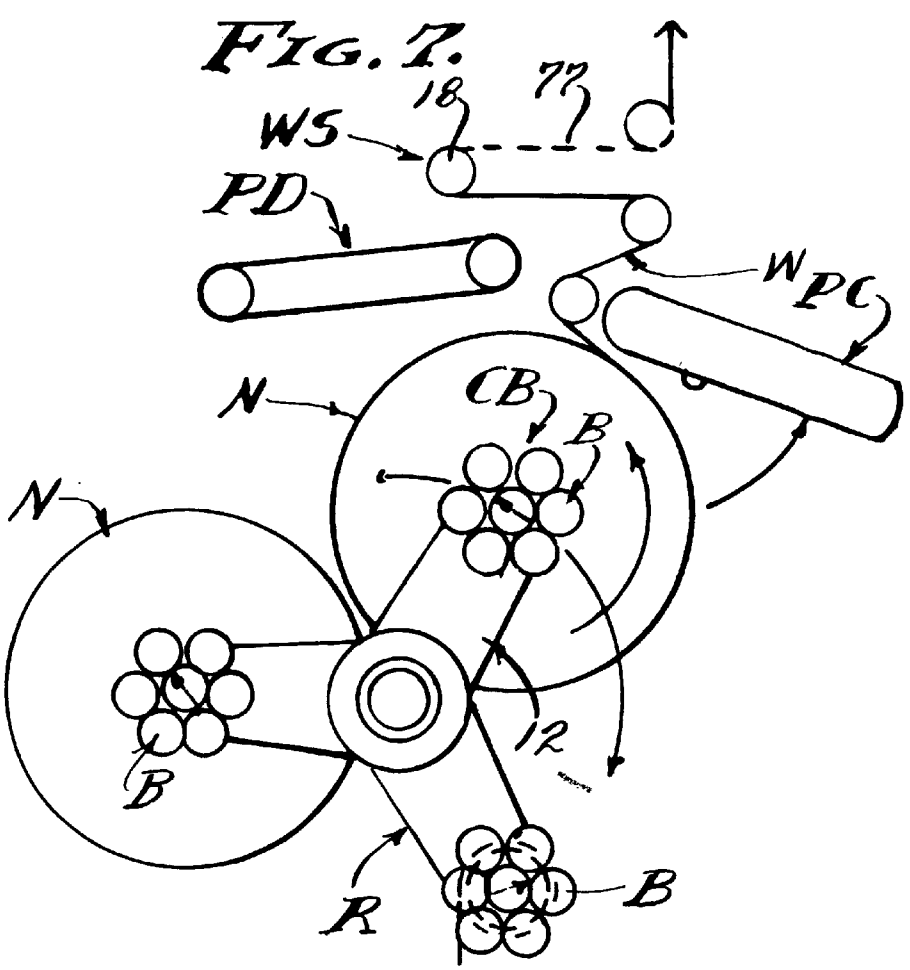

The RUNNING PHASE as shown in FIG. 7 is when the new roll of newsprint N has been spliced to the expired running web W continuing into the couples of the roll-press. Accordingly, the Pre-Drive PD and Paster-Cutter PC are retracted from their respective PASTE PHASE positions so as to free the new roll for indexing by the motor drive 15 into a feed position as may be required, at all times subject to control by the Tension Senser Means WS responsive to this Newsprint Core Brake System CB.

A feature of this system is the collective application of braking restraint applied through the plurality of brake means B1–B4 at the axes b, c and d. Accordingly, the new roll of newsprint N instantaneously feeds running web W subject to the restrain t of the caliper brake means B1–E4 applied directly to its core C.

Figure 1:
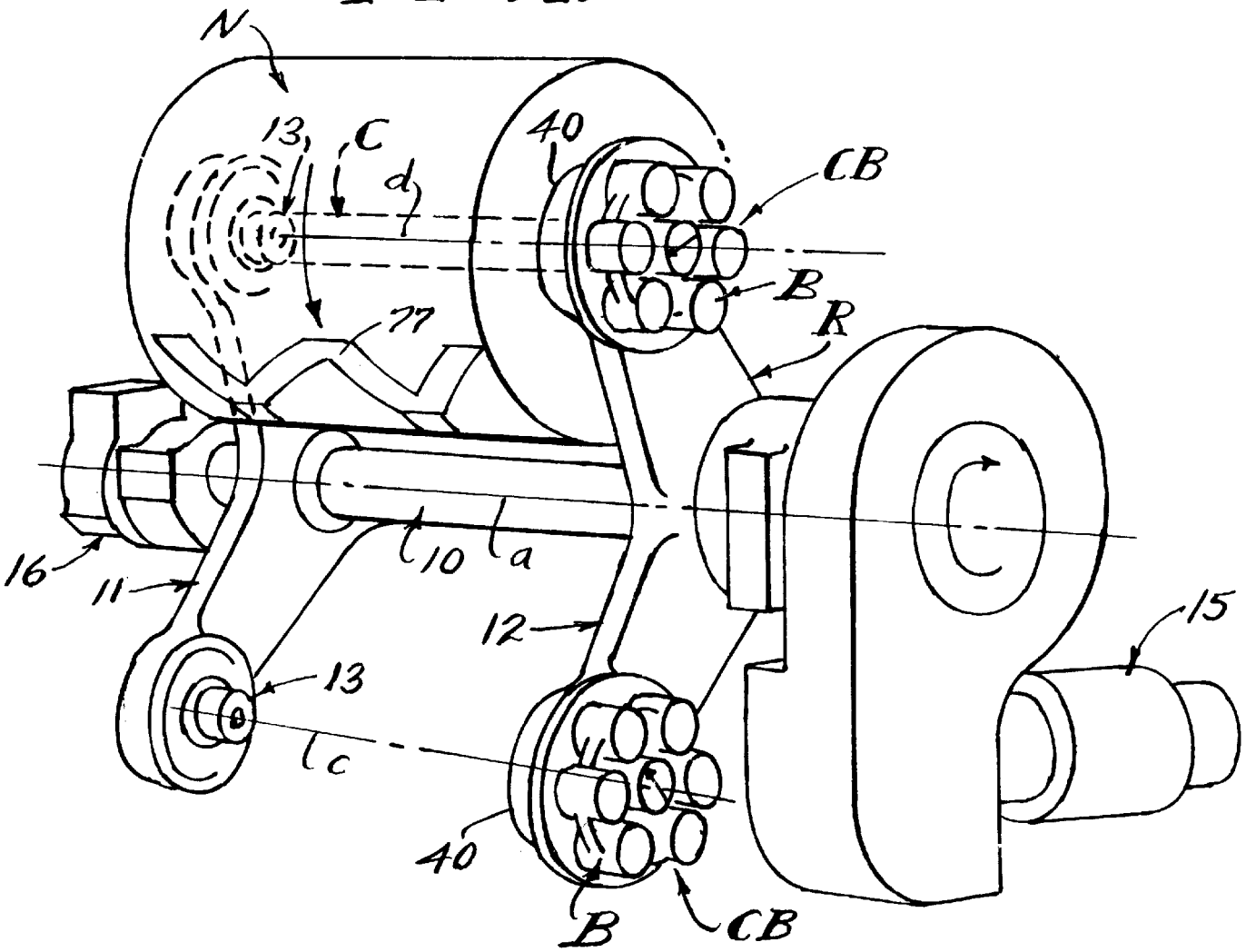
FIG. 1 is a perspective view of a newsprint reel, illustrating two of its three newsprint core axes, showing a New Roll ready for pre-drive, and showing the core braking system on each of the two visible axes.

Another feature of the present invention is that the brake caliper means B5 can be selectively activated for a "Stop" condition in the Glue Paster Pattern 77 position shown in FIGS. 1 and 6, in which case line 75 to the brake caliper B5 in the running position as shown in FIG.4 is closed by a normally open valve V7 (see FIG. 9) The "Makeup Position" for applying the Glue Paster Pattern 77 as shown in FIGS. 4–7 wherein a new roll of newsprint N is chucked onto a spindle 14 in the "Stop" condition. Accordingly, the newsprint in the Running Phase is made free for tension control only by the brake caliper means B1–B4.

Still another feature of the present invention is that state of the art electrical-electronic controls are employed substantially without change. For example, the emergency STOP control switch V6 is wired to the existing state of the art "Safety Circuit". And, the caliper means B5 replaces the prior art electric brake housed at each spider arm spindle; said electric brake being discarded, the function of caliper means B5 being controlled as hereinabove described by switches S5 and S7. Accordingly, caliper means B5 can be activated to hold a new newsprint roll in a selected rotative position for makeup of the glue paster pattern; and alternately activated immediately after a splice in the web W in order to stop the rotation of the expired roll and its core. Also, the state of the art provides an "Over-Ride Circuit" that activates the brake caliper means B5 into its braking mode for a normal "Running Stop". The emergency brake caliper means B6 is wired into the existing state of the art Emergency "RED BUTTON" stop circuit. In practice, the emergency brake caliper means B6 switch S6 circuit is wired into the state of the art full roll and three-quarter roll control circuit. Therefore, when the newsprint mass is high (inertia) an emergency STOP is effective. Alternately, the emergency STOP circuit is switched into the half and/or quarter roll circuit to activate an effective Running Stop or normal emergency braking.

Having described only the preferred forms and applications of my invention, I do not wish to be limited or restricted to the specific details herein set forth, but wish to reserve to myself any modifications or variations that may appear to those skilled in the art as set forth within the limits of the following claims.

I claim:

1. A newsprint core brake system for a continuous running roll press wherein a full and fractional part roll of newsprint web is supplied from newsprint core chucking spindles on an axis indexed into a running newsprint roll core position, and including;

a web tension sensor means with regulator means for increasing and decreasing a fluid pressure in a line according to the running web tension between the running newsprint roll and the roll press, at least one fluid pressure responsive brake means for each fractional part of the newsprint roll and coupled to a newsprint roll core chucking spindle in the running newsprint roll core position, the at least one fluid pressure responsive brake means being selectively connected by valve means to said regulator means fluid pressure line for alternately restraining and releasing a selected fractional portion of newsprint roll core rotation responsive to said regulator means fluid pressure.

2. The newsprint core brake system for a roll press as set forth in claim 1, wherein the fractional part roll is comprised of one to four integral sections and each corresponding to a printed page of newsprint.

3. The newsprint core brake system for a roll press as set forth in claim 1, wherein the at least one fluid responsive brake means is comprised of a disc rotatably driven by a core chucking spindle, and at least one caliper embracing said disc and responsive to said regulator means fluid pressure.

4. The newsprint core brake system for a roll press as set forth in claim 1, wherein the at least one fluid responsive brake means is comprised of a disc rotatably driven by a core chucking spindle, at least one caliper embracing said disc and responsive to said regulator means fluid pressure, and at least one additional caliper embracing said disc and having valve means from said regulator means for stopping rotation of the running newsprint roll core.

5. The newsprint core brake system for a roll press as set forth in claim 1, wherein the at least one fluid responsive brake means is comprised of a disc rotatably driven by a core chucking spindle, a multiplicity of calipers embracing said disc and each responsive to separate valve means to said regulator means fluid pressure, and at least one additional caliper embracing said disc and having separate valve means from said regulator means for stopping rotation of the running newsprint roll core.

6. A newsprint core brake system for a continuous running roll press wherein newsprint web is supplied from a reel apparatus having a central shaft disposed on an indexing axis and having spaced multi-armed spiders with newsprint core chucking spindles on axes positioned radially of and circumferentially spaced about said central shaft for rotatably indexing one of said chucking spindle axes from a pre-drive to a running newsprint roll core position, and including;

a web tension sensor means with regulator means for increasing and decreasing a fluid pressure in a line according to the running web tension between the running newsprint roll and the roll press, a pre-drive means for accelerating a new cored newsprint roll to the running web velocity of an expiring newsprint roll, a paster-cutter means for adjustment into close proximity to the running web and to the new cored newsprint roll running at the web velocity of the expiring newsprint roll for splicing thereof to the web of the expiring newsprint roll, a fluid pressure responsive brake means coupled to core chucking spindle at each core chucking spindle axis, the fluid pressure responsive brake means being collectively connected to said regulator means fluid pressure line for alternately restraining and releasing the newsprint role core rotation at each core chucking spindle axis responsive to said regulator means fluid pressure.

7. The newsprint core brake system for a roll press as set forth in claim 6, wherein the fluid responsive brake means is comprised of a disc rotatably driven by a core chucking spindle at each core chucking spindle axis, and at least one caliper embracing said disc and collectively responsive to said regulator means fluid pressure.

8. The newsprint core brake system for a roll press as set forth in claim 6, wherein the fluid responsive brake means is comprised of a disc rotatably driven by a core chucking spindle at each core chucking spindle axis, at least one caliper embracing said disc and collectively responsive to said regulator means fluid pressure, and at least one additional caliper embracing said disc and having separate valve means from said fluid regulator means for stopping rotation of the running newsprint roll core.

9. The newsprint core brake system for a roll press as set forth in claim 6, wherein the fluid responsive brake means is comprised of a disc rotatably driven by a core chucking spindle at each core chucking spindle axis, a multiplicity of calipers embracing said disc and collectively responsive to said regulator means fluid pressure through separate valve means, and at least one additional caliper embracing said disc and having separate valve means from said fluid regulator means for stopping rotation of the running newsprint roll core.

10. The newsprint core brake system as set forth in claim 6, there being a rotary union in said line to and from the fluid pressure responsive brake means rotatably indexed on said central shaft axis of the reel apparatus.

11. The news print core brake system as set forth in claim 10, wherein the rotary union is comprised of two relatively rotatable members, one member affixed over the axis of the central indexing shaft of the reel apparatus and the other member rotatable with a hub of a spider of the reel apparatus and with a fluid line extending to the fluid responsive brake means rotatably carried thereby.

12. A newsprint core brake system for a continuous running roll press wherein a full and fractional part roll of newsprint web is supplied from a reel apparatus having a central shaft disposed on an indexing axis and having spaced multi-armed spiders with newsprint core chucking spindles on axes positioned radially and circumferentially spaced about said central shaft for rotatably indexing one of said chucking spindle axes from a pre-drive to a running newsprint roll core position, and including;

a web tension sensor means with regulator means for increasing and decreasing a fluid pressure in a line according to the running web tension between the running newsprint roll and the roll press, a pre-drive means for accelerating a new cored newsprint roll to the running web velocity of an expiring newsprint roll, a paster-cutter means for adjustment into close proximity to the running web and to the new cored newsprint roll running at the web velocity of the expiring newsprint roll for splicing thereof to the web of the expiring newsprint roll, at least one fluid pressure responsive brake means coupled to a core chucking spindle at each core chucking spindle axis, the at least one fluid pressure responsive brake means being collectively connected to said regulator means fluid pressure line for alternately restraining and releasing a selected fractional portion of the newsprint roll core rotation at each core chucking spindle axis responsive to said regulator means fluid pressure.

13. The newsprint core brake system for a roll press as set forth in claim 12, wherein the fractional part roll is comprised of one to four integral sections and each corresponding to a printed page of newsprint.

14. The newsprint core brake system for a roll press as set forth in claim 12, wherein the at least one fluid pressure responsive brake means is comprised of a disc rotatably driven by a core chucking spindle, and at least one caliper embracing said disc and responsive to said regulator means fluid pressure.

15. The newsprint core brake system for a roll press as set forth in claim 12, wherein the at least one fluid responsive brake means is comprised of a disc rotatably driven by a core chucking spindle, at least one caliper embracing said disc and responsive to said regulator means fluid pressure, and at least one additional caliper embracing said disc and having valve means from said regulator means for stopping rotation of the running newsprint roll core.

16. The newsprint core brake system for a roll press as set forth in claim 12, wherein the at least one fluid responsive brake means is comprised of a disc rotatably driven by a core chucking spindle, a multiplicity of calipers embracing said disc and each responsive to separate valve means to said regulator means fluid pressure, and at least one additional caliper embracing said disc and separate valve means from said regulator means for stopping rotation of the running newsprint roll core.

17. A reel apparatus and newsprint core brake system for a roll press wherein newsprint web is supplied from a newsprint roll core rotatably indexed to a running newsprint roll core position, and including;

a central rotatable shaft disposed on an indexing axis and having spaced multi-armed spiders with newsprint core chucking spindle axes positioned radially of and circumferentially spaced about said central shaft for rotatably indexing one of said chucking spindles to a running newsprint roll core position, a web tension sensor means with regulator means for increasing and decreasing a fluid pressure in a line according to the running web tension between the running newsprint roll and the roll press, a fluid pressure responsive brake means coupled to a core chucking spindle at each core chucking spindle axis, the fluid pressure responsive brake means being collectively connected to said regulator means fluid pressure line for alternately restraining and releasing the newsprint role core rotation at each core chucking spindle axis responsive to said regulator means fluid pressure.

18. The reel apparatus and newsprint core brake system for a roll press as set forth in claim 17, wherein the reel includes a stationary member spaced axially from a hub face of an endmost spider rotatably positioned by the central rotatable shaft, there being adapter means affixed to said spider hub face for carrying the stationary member in fixed relation to said hub face.

19. The reel apparatus and newsprint core brake system for a roll press as set forth in claim 17, wherein the reel includes a stationary member spaced axially from a hub face of an endmost spider rotatably positioned by the central rotatable shaft, there being union means comprised of relatively rotatable members, a first member affixed to said spider hub to turn therewith, and a second member affixed to the stationary member and there being a fluid passage means open radially between said relatively rotatable first and second members for conducting regulator means fluid pressure to the fluid pressure responsive brake means.

20. The reel apparatus and newsprint core brake system for a roll press as set forth in claim 17, wherein the reel includes a stationary member spaced axially from a hub face of an endmost spider rotatably positioned by the central rotatable shaft, there being adapter means affixed to said spider hub for carrying the stationary member in fixed axial relation to said hub face, and there being union means comprised of relatively rotatable members, a first member affixed to said spider hub face to turn therewith, and a second member affixed to the stationary member and there being a fluid passage means open radially between said relatively rotatable first and second members for conducting regulator means fluid pressure to the fluid pressure responsive brake means.

21. The reel apparatus and newsprint core brake system as set forth in claim 17, wherein the fluid pressure responsive brake means is a disc and caliper means for juxtapositioned placement of brake pads to said disc, with substanitally "Zero" stroke and thereby instantaneously responsive to the regulator means fluid pressure.

22. The reel apparatus and newsprint core brake system as set forth in claim 17, wherein the multi-armed spider includes a spindle housing with the core braking spindle extended therefrom to carry the fluid pressure responsive brake means comprised of disc and caliper means for juxtaposioned placement of brake pads to said disc, with substantially "Zero" stroke and thereby instantaneously responsive to the regulator means fluid pressure.

23. The reel apparatus and newsprint core brake system as set forth in claim 21, wherein there is a caliper means for each running web section of newsprint.

24. The reel apparatus and newsprint core brake system as set forth in claim 21, wherein there is a caliper means for each running web section of newsprint, and an additional caliper means for a normal STOP.

25. The reel apparatus and newsprint core brake system as set forth the claim 21, wherein there is a caliper means for each running web section of newsprint, an additional caliper means for a normal STOP, and an additional caliper means for an emergency STOP, all caliper means being activated for said emergency STOP.

26. The reel apparatus and newsprint core brake system for a roll press as set forth in claim 17, wherein the reel includes a stationary housing member spaced axially from a hub face of an endmost spider rotatably positioned by the central rotatable shaft, there being adapter means affixed to said spider hub face for carrying the stationary housing member in fixed axial relation to said hub face, there being commutation means within said stationary housing member for controlling reel apparatus and core braking functions, and including solenoid valve means carried by said spider arms for selectively opening the regulator means fluid pressure to each caliper means.

* * * * *